US009303210B2

(12) United States Patent
Badura

(10) Patent No.: US 9,303,210 B2
(45) Date of Patent: Apr. 5, 2016

(54) APPARATUS AND PROCESS FOR THE DISCHARGE OF QUENCHED OR UNQUENCHED COKE FROM A COKE QUENCHING CAR INTO A RECEIVING DEVICE

(75) Inventor: Sven Badura, Bottrop (DE)

(73) Assignee: THYSSENKRUPP UHDE GMBH, Dortmund (DE)

( * ) Notice: Subject to any disclaimer, the term of this patent is extended or adjusted under 35 U.S.C. 154(b) by 862 days.

(21) Appl. No.: 13/511,862

(22) PCT Filed: Nov. 12, 2010

(86) PCT No.: PCT/EP2010/006913

§ 371 (c)(1),
(2), (4) Date: Jul. 24, 2012

(87) PCT Pub. No.: WO2011/063898

PCT Pub. Date: Jun. 3, 2011

(65) Prior Publication Data

US 2013/0118884 A1 May 16, 2013

(30) Foreign Application Priority Data

Nov. 25, 2009 (DE) ..... 10 2009 054 430

(51) Int. Cl.
*C10B 39/12* (2006.01)
*C10B 33/10* (2006.01)
(Continued)

(52) U.S. Cl.
CPC ..... *C10B 39/12* (2013.01); *C10B 33/08* (2013.01); *C10B 33/10* (2013.01); *C10B 39/04* (2013.01); *C10B 45/00* (2013.01)

(58) Field of Classification Search
CPC ..... C10B 33/08; C10B 33/10; C10B 39/04; C10B 39/12; C10B 45/00
USPC ..... 201/2; 202/117
See application file for complete search history.

(56) References Cited

U.S. PATENT DOCUMENTS 3,272,356 A * 9/1966 Lovetro ..... 414/215
3,959,083 A 5/1976 Goedde et al.

(Continued)

FOREIGN PATENT DOCUMENTS

CN 2668641 1/2005
DE 2320057 8/1974

(Continued)

OTHER PUBLICATIONS

International Search Report for PCT/EP2010/006913, English translation attached to original, Both completed by the European Patent Office on Mar. 15, 2011, All together 5 Pages.

*Primary Examiner* — Renee E Robinson
*Assistant Examiner* — Jonathan Miller
(74) *Attorney, Agent, or Firm* — Brooks Kushman P.C.

(57) ABSTRACT

An apparatus for the discharge of quenched or unquenched coke from a coke quenching car into a receiving device, providing that there is an extension of the pusher machine beside at least one coke-oven chamber, which is arranged in one line with the coke-oven chambers, and which is to be operated by the pusher machine, and that there is a receiving device behind the quenching car as seen from the coke-oven battery into which the coke can be pushed from the quenching car by the extension, the receiving device preferably being a wharf. A process for the discharge of the hot coke from a coke quenching car into a receiving device is also disclosed. Capacity bottlenecks of the quenching equipment are compensated so that the coke need not stay in the coke-oven chamber after the end of the coking process, or disturbances of the quenching equipment can be compensated temporarily.

16 Claims, 4 Drawing Sheets

(51) Int. Cl.

| | |
|---|---|
| ***C10B 33/08*** | (2006.01) |
| ***C10B 39/04*** | (2006.01) |
| ***C10B 45/00*** | (2006.01) |

(56) References Cited

U.S. PATENT DOCUMENTS

| | | | | |
|---|---|---|---|---|
| 7,998,316 | B2 * | 8/2011 | Barkdoll | 201/39 |
| 8,152,970 | B2 | 4/2012 | Barkdoll et al. | |
| 8,236,142 | B2 * | 8/2012 | Westbrook | 201/39 |
| 2011/0056821 | A1 | 3/2011 | Schuecker | |

FOREIGN PATENT DOCUMENTS

| | | |
|---|---|---|
| WO | 9945083 | 9/1999 |
| WO | 2007103649 | 9/2007 |
| WO | 2009121469 | 10/2009 |

* cited by examiner

APPARATUS AND PROCESS FOR THE DISCHARGE OF QUENCHED OR UNQUENCHED COKE FROM A COKE QUENCHING CAR INTO A RECEIVING DEVICE

CROSS-REFERENCE TO RELATED APPLICATIONS

This application is the U.S. national phase of PCT Appln. No. PCT/EP2010/006913 filed Nov. 12, 2010, which claims priority to German application DE 10 2009 054 430.5 filed Nov. 25, 2009, the disclosures of which are incorporated in their entirety by reference herein.

TECHNICAL FIELD

The invention relates to an apparatus by which quenched or unquenched coke is made available, this apparatus consisting of an extension of the pusher ram of the pusher machine, which is about of the length of a coke-oven chamber and arranged in one line with the coke-oven chambers, and which is pushed into the coke quenching car by the pusher machine so that the coke drops into a wharf provided behind the coke quenching car. The invention also relates to a process for the discharge of quenched or unquenched coke filled into a coke quenching car, the coke being discharged from the coke quenching car into a wharf so that the capacity of the coke wharf assigned to the quench tower is temporarily increased or an emergency discharge of the coke quenching car permitted, when the quench tower is temporarily not ready for coke quenching.

BACKGROUND

Processes for pushing the coke from a coke-oven chamber are well-known. Normally the coal is loaded into the coke-oven chamber, which can be heated from at least two sides, so that the coal is heated and the volatile coking gases degas so that the coal is converted into coke zone by zone from the walls of the coke-oven chamber so that the oven chamber yields a coke cake, which, after degassing of the volatile matter contained in the coal, is pushed into a quenching car by means of a pusher ram which travels through the coke-oven chamber.

In normal operation, a quenching car is used to take the glowing coke under a quench tower where it is typically quenched with water. In the meantime, the emptied coke oven is promptly re-loaded with new coal. The quenched coke can be discharged from a quenching car onto a coke wharf where it steams off before a conveyor belt takes it to a coke screening unit.

DE 2320057 B1 describes a process and an apparatus for the quenching of a heated material to be quenched, this material to be quenched in particular being coke, which is quenched by means of a liquid flowing through the bulk material from top to bottom; here, the bulk material height over a basically horizontal support surface covered by the bulk material is kept constant on certain conditions for steaming off, and the amount of quenching liquid evenly distributed across the bulk material is determined in a manner known per se such that it evaporates except for the part absorbed by the bulk material. The description of the process includes the discharge of the quenched coke onto a wharf.

During operation, however, disturbances of the quenching system or of the receiving devices following the quenching system may occur. In such case, the intake capacity of the quenching system will not be large enough to quench all the coke that is produced during the operation of a coke-oven battery. The excessive coke will then either burn or must be left in a coke-oven chamber for an inadequately long period. This is, however, not wanted for economical reasons. It may also happen that the quenching system stops functioning properly during operation so that the coke discharged from the coke-oven chambers cannot be quenched anymore or that full intake capacity of the receiving device assigned to the quench tower has been reached.

For this reason it would be of decisive advantage to have a process for the coke discharged from a coke-oven chamber by which it is transferred into a suitable receiving device, where the coke is quenched in the before-mentioned operational phases. This receiving device may theoretically be of any type desired, must, however, be suited for the discharge of coke which is possibly still burning or glowing. This device should also be provided with an auxiliary device to implement temporary coke quenching. It would be of further advantage if no additional equipment was required for the process so that the process was basically carried out with coke-oven batteries adequately known according to the state of the art.

SUMMARY

The invention achieves this aim by an apparatus which consists of at least one stationary extension of the pusher ram, which is installed beside at least one coke-oven chamber and is arranged in one line or in alignment with the coke-oven chambers of the coke-oven battery or series of coke ovens. The extension is operated by the pusher machine, a receiving device being installed behind the quenching car—as seen from the coke-oven battery—into which the coke from the quenching car can be pushed by means of the extension. The invention achieves this aim also by a process by which the coke from the quenching car is transferred in quenched condition into a provided empty receiving device where the coke is stored for a limited time in quenched or unquenched condition. The receiving device is preferably a wharf.

Particularly claimed is an apparatus which serves to discharge quenched or unquenched coke from a coke quenching car into a receiving device and which is an integral part of a coke-oven battery or series of coke ovens, providing that

- a number of coke-oven chambers are combined to a coke-oven battery or series of coke ovens, and
- a pusher machine travelling in parallel is provided in front of the coke-oven chamber front wall on the pusher side, and
- a quenching car travelling in parallel is provided in front of the coke-oven chamber front wall on the coke side, which can be moved into a quench tower, and which is characterised in that

- at least one extension of the pusher ram is installed beside at least one coke-oven chamber, this extension being arranged in one line with the coke-oven chambers and having to be operated by the pusher machine, and
- a receiving device is provided on the coke side behind the quenching car as seen from the coke-oven battery—into which the coke from the quenching car can be pushed by means of the extension.

The apparatus which consists of a stationary extension of the pusher machine travelling in parallel to the coke-oven chamber front can be provided in any optional number and arrangement. It is, for example, also possible to arrange it between two coke-oven chambers within a coke-oven battery or series of coke ovens. Preferably, however, the extension is arranged at one of the two end sides of the coke-oven battery. It is also possible to provide one of these apparatuses each at both ends.

The apparatus according to the invention comprising the stationary extension may also be used in a system of coke-oven chambers consisting of two coke-oven batteries arranged in parallel, a pusher machine and a quenching car being arranged on optional sides. An example of a design type of two coke-oven batteries facing each other and running in parallel is described in WO 2009121469 A1.

In an optional embodiment, the coke-oven battery is a system of coke-oven batteries arranged in parallel, which is equipped with two pusher devices arranged at the outer ends and travelling in parallel to the coke-oven chamber front, and in which at least one receiving device is arranged between the coke-oven batteries, so that the coke is to be discharged from the quenching car into the internally arranged receiving device by means of the extension of one of the pusher machines arranged at the outer ends.

In another optional embodiment, the coke-oven batteries are a system of coke-oven batteries arranged in parallel, which is equipped with at least one pusher machine travelling in parallel to the coke-oven chamber front and being arranged between the coke-oven batteries; here the coke is to be discharged from the quenching car into the receiving device at the outer end by means of the extension to one of the internally arranged pusher machines according to the invention. In both of these embodiments the receiving device is arranged in one line or in alignment with the extension such that the coke is to be discharged from the quenching car into this receiving device by means of the pusher machine. In principle, however, the system of pusher device—extension—receiving device can be provided in any optional arrangement and number.

The receiving device is preferably a wharf. The extension device can be of any optional design. In an exemplary embodiment the embodiment-specific device is a pusher ram. In another embodiment the extension device is a steel girder. The pusher ram or the girder may, for example, be fitted with buffers or holding plates.

To provide movability in direction of the quenching car, the extension is, for example, fitted with rollers to allow travelling mobility in parallel with the coke-oven chambers. These rollers can be arranged underneath or above the extension, the extension then being connected with the rollers by means of suspension fixtures. In another embodiment the extension device is fitted with guide shoes for ensuring travelling mobility in parallel with the coke-oven chambers. In such case, these may, for example, be arranged underneath the extension. For this, the guide shoes are, for example, supported by a receiving guide rail or plate. Here as well, however, an embodiment is conceivable where the extension is suspended on rollers.

The other parts of the apparatus are well-known according to the state of the art. As far as the design of the quenching car is concerned, especially cars of the flat-bed type can be used. These do not require any additional auxiliary equipment when being loaded with the pushed-out coke cake and pushed by the apparatus embodying the invention. Examples of flat-bed quenching cars are mentioned in CN 2668641 Y. In principle, any sort of quenching car is suitable into which a coke cake can be pushed without any additional auxiliary equipment.

Also claimed is a process by which quenched or unquenched coke can be discharged from a coke quenching car into a receiving device and for which the apparatus embodying the invention is used.

Claimed in particular is a process by which unquenched or quenched coke is discharged from a coke quenching car into a receiving device, in which

- the coke-oven chamber is first loaded with coal, and the coal is heated in the oven chamber to convert the coal into coke, and
- a pusher ram of a pusher car moves through the oven chamber to push out the coke cake and pushes the coke directly into a quenching car via the coke-cake transport car or a coke transfer car, and characterised in that

- the quenching car moves in front of a provided empty receiving device, and the quenched or unquenched coke is pushed from the quenching car into a provided empty receiving device.

If the receiving device assigned to the quench tower is full already, it is possible to use the receiving device embodying the invention for the coke which has already been quenched in the quench tower. If there is no spare quenching capacity, for example because the quench tower is not available, the coke can be pushed into the receiving device embodying the invention in unquenched condition. The coke is then quenched by auxiliary equipment. This may be quenching guns, for example, or quenching nozzles adequately known according to the state of the art. An example for the quenching of hot coke by means of quenching nozzles is given in DE 573867 C.

Depending on the necessity, the coke is transported by suitable conveying devices from the receiving device to subsequent applications. These are adequately known according to the state of the art. An example of a wharf with suitable downstream conveying equipment is given in DE 1269999 C.

For the purpose of the invention it is also possible, however, to use a dry cooling tower. The invention is suited for any type of coke-oven chambers, is, however, particularly suited for coke-oven chambers and coke-oven batteries of the "non-recovery" or the "heat recovery" type.

The apparatus embodying the invention involves the advantage that it is suited for discharging the coke, which may possibly still burn or glow, into a receiving device and can be provided with an auxiliary device allowing temporary quenching of the coke, not requiring any additional equipment, so that the process can generally include coke-oven batteries as they are adequately known according to the state of the art. The process embodying the invention allows compensating capacity bottlenecks with regard to the quenching equipment or the receiving device assigned to the quenching device.

BRIEF DESCRIPTION OF THE DRAWINGS

The invention is explained by means of three drawings, these drawings only representing exemplary embodiments of the invention.

DETAILED DESCRIPTION

Figure 1:
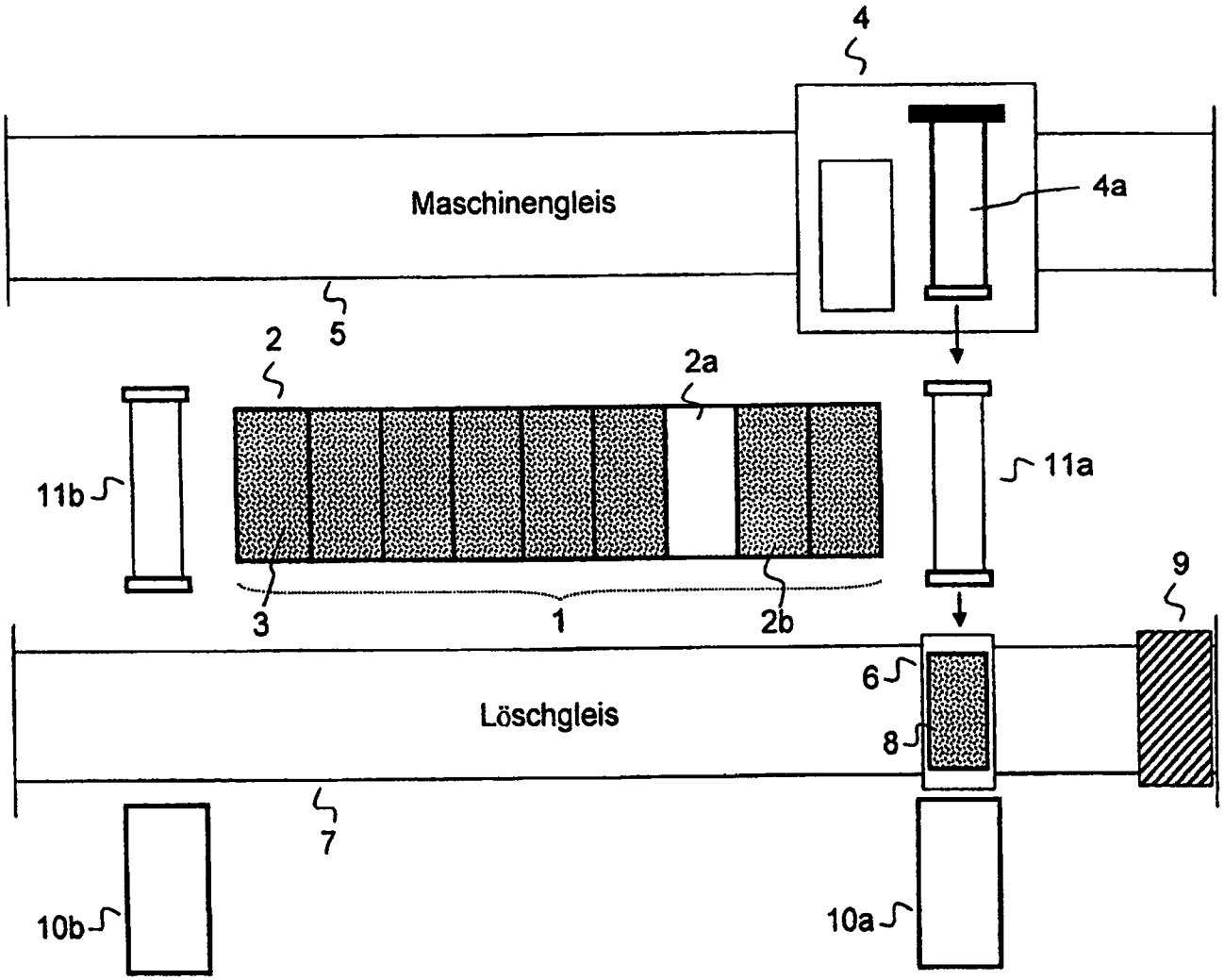
FIG. 1 shows a top view of a coke-oven battery with the apparatus embodying the invention in vertical perspective.

FIG. 1 shows a coke-oven battery (1) consisting of a series of coke-oven chambers (2). The coke-oven chambers have been loaded with coke (3) or coal which is converted by coking into coke. One of the coke-oven chambers (2*a*) has just been emptied and does not contain any coke (3); the other coke-oven chambers (2) are full of coal (2*b*) or coke. In parallel with the front of the coke-oven chamber front, a pusher machine (4) travels along a machine rail (5). To perform the pushing process, a pusher device (4*a*) is moved from the pusher machine (4) into the coke-oven chamber (2). The coke is pushed into the quenching car (6) which is arranged on a quenching rail (7) and travels in parallel along the front of the coke-oven battery (1) on the opposite side of the machine rail (5). Coke-quenching car (6) is depicted with pushed-out coke (8). The pushed-out and still glowing coke (8) is then conveyed to the quench tower (9) where it is quenched. Subsequently the quenching car (6) moves in front of the wharf (10*a*) into where the coke is dumped from the quenching car (6). Alternatively to the wharf (10*a*), the coke (8) loaded onto the quenching car (6) can also be pushed into the second wharf (10*b*) by means of the second pusher device extension (11*b*) together with the pusher device (4*a*) which serves to push the coke (8) from the quenching car (6) into the wharf (10*b*). In emergency operation, the quenching car (6) would be moved directly to the wharf (10*b*) and the still glowing, already pushed-out coke (8) would be pushed from the quenching car (6) onto the wharf (10*b*) by means of the extension of the pusher device (11*b*).

Figure 2:
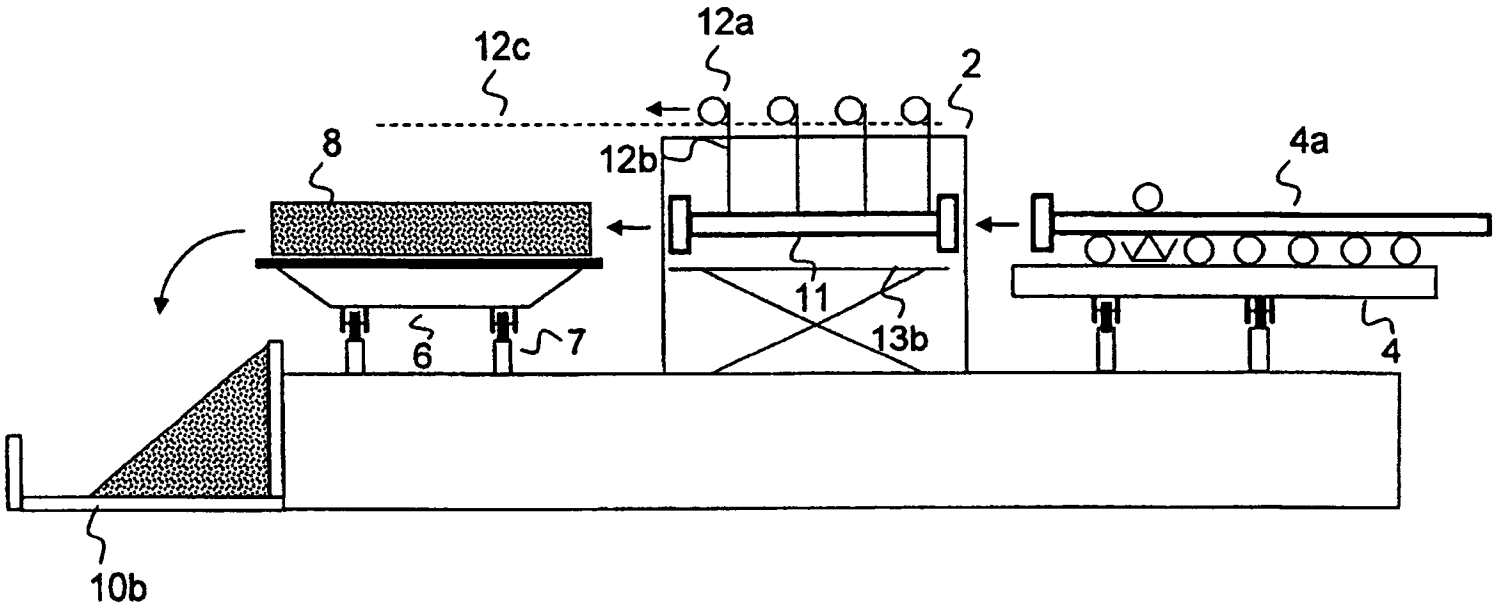
FIG. 2 and FIG. 3 show lateral views of the apparatus laterally in one line with the coke-oven chamber arranged behind it.

FIG. 2 shows the apparatus embodying the invention which consists of an extension (11) suspended by rollers (12*a*). Behind the extension (11) there is a coke-oven chamber (2). The rollers (12*a*) are connected with the extension (11) via suspension devices (12*b*). The rollers (12*a*) are supported by a guide rail (12*c*) so that the extension (11*a*) can be moved in direction of the coke quenching car (6). The extension (11*a*) is pushed into the flat-bed quenching car (6) by means of the pusher ram (4*a*) of the pusher machine (4) so that the pushed-out coke cake (8) drops into the provided wharf (10*b*). The pusher ram (4*a*) of the pusher device (4) can also be supported by guide shoes (13*a*) which will travel along guide rails (13*b*) as the pushing process continues.

Figure 3:
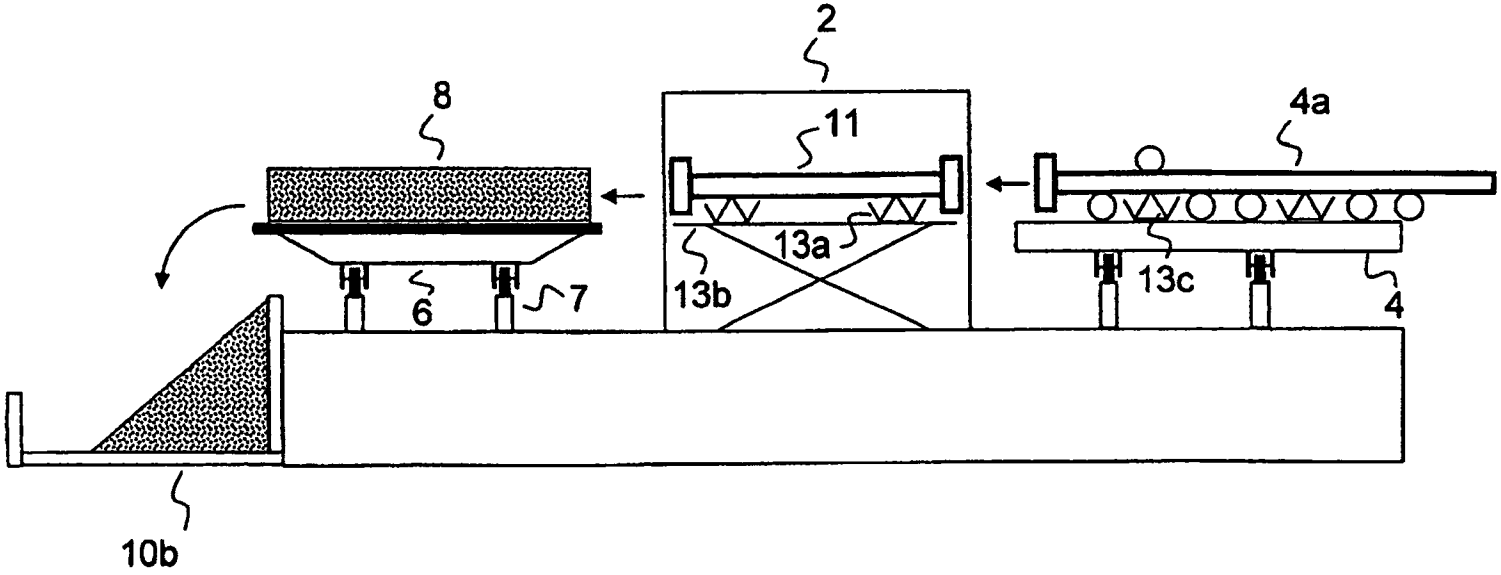
Figure 4:
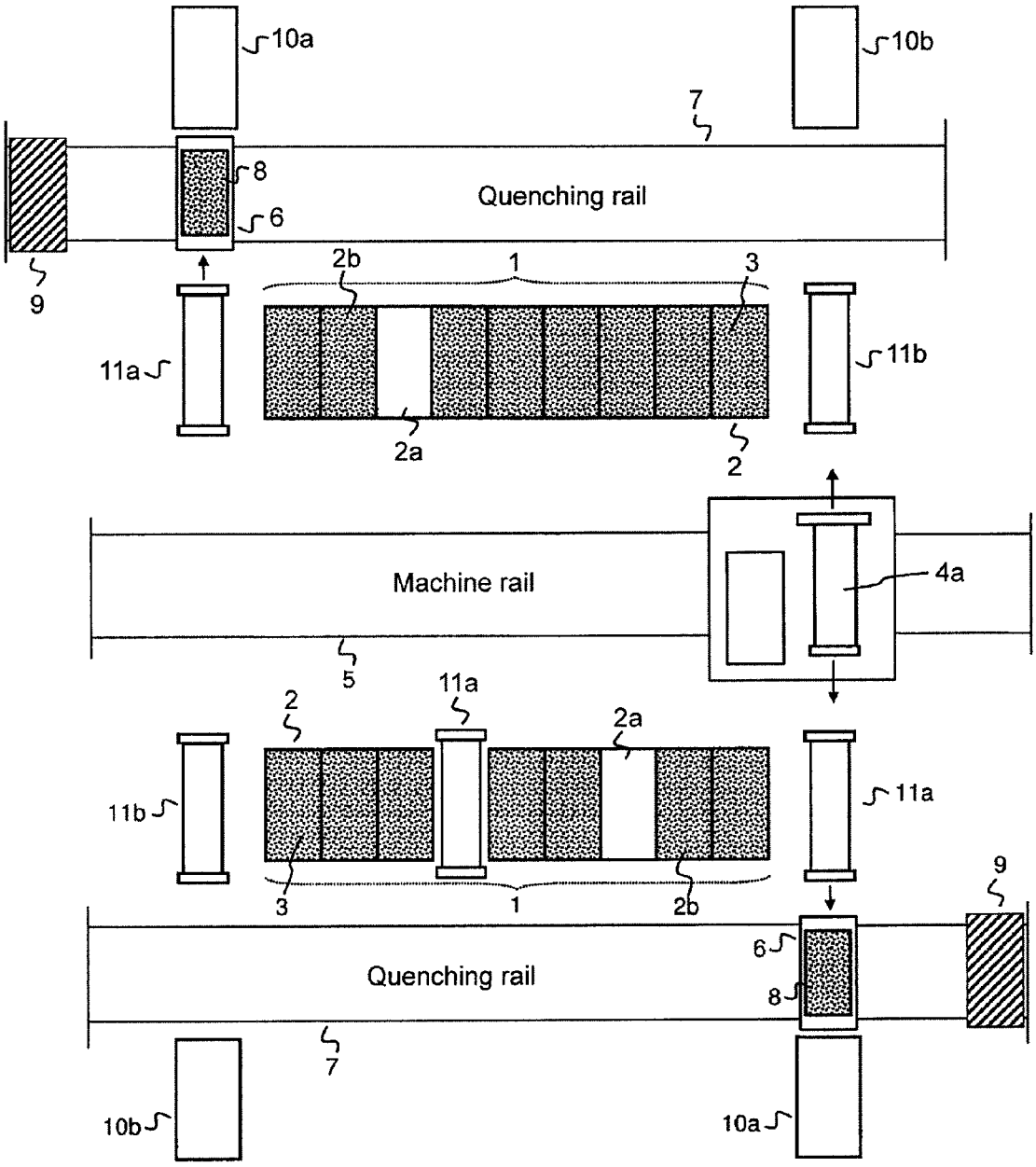
FIG. 4 illustrates an embodiment of the invention wherein the pusher machine is located between the front faces of two parallel coke oven batteries, and wherein a pusher ram extension is located between ovens of a battery.

FIG. 3 shows the apparatus embodying the invention which consists of an extension (11) which is supported by guide shoes (13*a*). The guide shoes (13*a*) are in turn supported by guide rails (13*b*). Behind the extension (11*a*) there is a coke-oven chamber (2). The extension (11*a*) is pushed into the flat-bed quenching car (6) by means of the pusher ram (4*a*) of the pusher machine (4) so that the already pushed-out coke cake (8) drops into the provided wharf (10). The pusher ram (4*a*) of the pusher device (4) is also supported by guide shoes (13*c*) which will travel along the guide rail (13*b*) of the extension (11) as the pushing process continues.

LIST OF REFERENCE NUMBERS AND DESIGNATIONS

1 Coke-oven battery
2 Coke-oven chamber
2*a* Empty coke-oven chamber
2*b* Coke-filled chamber
3 Coal
4 Pusher machine
4*a* Pusher device
5 Machine rail
6 Quenching car
7 Quenching rail
8 Pushed-out coke cake
9 Quench tower
10*a* Wharf
10*b* Second wharf
11 Extension
11*a* Pusher device extension
11*b* Second pusher device extension
12*a* Rollers
12*b* Suspension devices
12*c* Guide rail
13*a* Guide shoes
13*b* Guide rail
13*c* Guide shoes of pusher ram of pusher machine

The invention claimed is:

1. In a coking facility comprising at least one coke battery comprising a plurality of coke ovens, an apparatus for discharge of quenched or unquenched coke from a coke quenching car into a receiving device, a pusher machine having an extendable pusher ram with a length sufficient to push coke from within an oven of the coke battery into a coke quenching car as the extendable pusher ram is extended, wherein the coke battery has a front side and a rear side, the pusher machine traveling parallel to the front side, and the quenching car traveling parallel to the rear side, the improvement comprising:

mounting at least one pusher ram extension adjacent a side of at least one coke oven of the coke oven battery, the pusher ram extension oriented parallel to the side of the at least one coke oven, the pusher ram extension temporarily extending the length of the extendable pusher ram so as to extend through the quenching car and push coke in the quenching car into a receiver located on a side of the quenching car remote from the rear side of the coke oven battery.

2. The coking facility of claim 1, wherein the pusher ram extension is mounted at one of two end sides of the coke-oven battery.

3. The coking facility of claim 1, wherein the pusher ram extension is mounted between two coke-ovens of the coke-oven battery.

4. The coking facility of claim 1, wherein two opposing coke oven batteries are arranged in parallel with their front sides facing each other, wherein the pusher machine is located between the two coke oven batteries so as to be able to push coke from coke ovens in either battery, a pusher ram extension mounted at at least one end of each coke battery, and comprising two quencher cars traveling parallel to the rear sides of the coke oven batteries, one quencher car on the rear side of each coke oven battery, and at least two receivers, the receivers positioned beyond the respective quenching cars and in parallel with the pusher ram extension.

5. The coking facility of claim 4, wherein the receivers each comprise a ramp.

6. The coking facility of claim 1, wherein two opposing coke oven batteries are arranged in parallel with their rear sides facing each other, at least one quenching car which travels in parallel between the two coke oven batteries, a pusher ram extension mounted at at least one end of each coke battery, two pusher machines, one pusher machine traveling parallel to the front of each coke oven battery, and at least one receiver in each coke oven battery opposite the pusher ram extension for receiving coke pushed into the quenching car from the opposing coke oven battery.

7. The coking facility of claim 1, wherein the receiver is a wharf.

8. The coking facility of claim 1, wherein the pusher ram extension has guide shoes to enable movement in parallel along the length of the coke-oven.

9. The coking facility of claim 1, wherein the pusher ram extension is fitted with rollers for travelling in parallel along the length of the coke-ovens.

10. A process for discharge of quenched or unquenched coke from a coking facility comprising a plurality of coke ovens in a coke oven battery, comprising:

pushing coke from a coke oven of the coke oven battery by a pusher ram on a traveling pushing machine into a quenching car;

positioning the quenching car in front of a pusher ram extension mounted adjacent to a coke oven of the coke oven battery, positioning the traveling pushing machine in front of the pusher ram extension; and pushing coke through the quenching car into a receiver positioned on an opposite side of the quenching car from the pusher ram extension.

11. The process of claim 10, wherein the coke in the quenching car which is pushed into the receiver is unquenched coke.

12. The process of claim 11, wherein the unquenched coke is discharged into the receiver and then quenched by auxiliary equipment.

13. The process of claim 11, wherein the auxiliary quenching equipment comprises one or several quenching guns for each receiver.

14. The process of claim 11, wherein the coke is transported by a conveying device from the receiver to subsequent applications.

15. The process of claim 10, wherein the pusher ram extension is fitted with guide shoes for ensuring travelling mobility in parallel with the coke-oven chambers.

16. The process of claim 10, wherein the pusher ram extension is fitted with rollers for ensuring travelling mobility in parallel with the coke-oven chambers.

* * * * *